US006804862B2

(12) United States Patent
Miller

(10) Patent No.: US 6,804,862 B2
(45) Date of Patent: Oct. 19, 2004

(54) HINGE SYSTEM

(75) Inventor: Michael R. Miller, Winnetka, IL (US)

(73) Assignee: Miller Dowel Company, Winnetka, IL (US)

( * ) Notice: Subject to any disclaimer, the term of this patent is extended or adjusted under 35 U.S.C. 154(b) by 42 days.

(21) Appl. No.: 10/310,227

(22) Filed: Dec. 5, 2002

(65) Prior Publication Data

US 2004/0107541 A1 Jun. 10, 2004

(51) Int. Cl.[7] ..... E05D 5/10
(52) U.S. Cl. ..... 16/386; 16/254
(58) Field of Search ..... 16/386, 254, 263

(56) References Cited

U.S. PATENT DOCUMENTS

| | | | | |
|---|---|---|---|---|
| 111,515 A | | 2/1871 | Clark | |
| 713,338 A | | 11/1902 | Paquette | |
| 1,429,416 A | * | 9/1922 | Fade | 16/330 |
| 1,484,536 A | | 2/1924 | Way | |
| 2,522,502 A | | 12/1950 | Philips | |
| 2,937,399 A | | 5/1960 | de Vore | |
| 2,997,734 A | | 8/1961 | Dyer | |
| 3,292,204 A | * | 12/1966 | Tansey | 16/263 |
| 3,448,486 A | | 6/1969 | Wright | |
| 3,826,565 A | * | 7/1974 | Wenzel | 351/121 |
| 4,135,273 A | | 1/1979 | Holmes | |
| 4,484,760 A | * | 11/1984 | Rach | 280/477 |
| 4,524,486 A | | 6/1985 | Rios | |
| 4,573,239 A | | 3/1986 | Valenti | |
| 4,979,263 A | * | 12/1990 | Tolle | 16/262 |
| 5,054,630 A | * | 10/1991 | Altherr | 213/56 |
| 5,145,076 A | | 9/1992 | Murphy | |
| 5,577,295 A | * | 11/1996 | Papke et al. | 16/254 |
| 5,722,121 A | | 3/1998 | Lau | |
| 5,761,769 A | * | 6/1998 | Bruckner et al. | 16/342 |
| 5,943,738 A | | 8/1999 | Karfiol | |
| 6,178,599 B1 | * | 1/2001 | Worden et al. | 16/386 |

FOREIGN PATENT DOCUMENTS

GB 2217776 A * 11/1989

* cited by examiner

*Primary Examiner*—Chuck Y. Mah
*Assistant Examiner*—Michael J. Kyle
(74) *Attorney, Agent, or Firm*—Welsh & Katz, Ltd.

(57) ABSTRACT

The hinge system has a hinge pin having a plurality of cylinders. Each of the cylinders has at least one section having a predetermined diameter, a first cylinder of the plurality of cylinders having a first diameter with every succeeding cylinder having one of a diameter equal to or less than a diameter of a preceding cylinder. The cylinders are arranged end-to-end on a common axis. A first leaf of the hinge systems includes an attachment portion and at least one elongated knuckle portion located on one edge of the attachment portion. The knuckle portion of the first leaf is axially continuous and has an axial extending bore having at least one section having a predetermined diameter. A second leaf of the hinge system includes an attachment portion and at least one knuckle portion along one edge of the attachment portion. The knuckle portion of the second leaf has an axially extending bore, having at least one section having a predetermined diameter, coaxial with the bore of the knuckle portion of the first leaf. The bores of the knuckle portions of the first and second leaves define an axially extending passage having different diameters that correspond to the diameters of the cylinders of the hinge pin. The hinge pin extends through the passage defined by the knuckle portions of the first and second leaves to provide a pivotal connection between the first and second leaves.

7 Claims, 6 Drawing Sheets

HINGE SYSTEM

CROSS REFERENCE TO RELATED APPLICATIONS

This application relates to U.S. patent application Ser. No. 10/302,402, filed Nov. 22, 2002, and U.S. Pat. No. 6,267,527 and D456,700, all of which are hereby incorporated by reference.

FIELD OF THE INVENTION

The present invention relates to hinge systems, and more particularly to hinge systems having pins that are dowels that provide for decreasing diameters over the length of the dowel and that provide enhanced connection of the leaves of a hinge.

BACKGROUND

The cooperating leaves of hinges such as strap and T-hinges are generally formed by metal stamping equipment from heavy gauge steel sheet. These leaves have an attachment portion for securing the hinge to a door or gate and to the associated door or gate frame, and one or more prongs or knuckles thereon which have aligned apertures there through and which define a barrel or passage in which is seated a hinge pin or pins. Once the leaves are attached to a door and doorframe, it is well known that it is often difficult to align the passages of the leaves such that the pin is easily insertable.

Hinge pins of various types are known in the art. One known hinge has a first leaf including an attachment portion and a knuckle portion centrally located on one edge of the attachment portion, and has a passage extending axially there through. Pair of bearing inserts are located at the opposite ends of the knuckle portion and extend into its axial passage, and each of the inserts has a tubular body portion of generally circular cross section. A radially outwardly extending flange portion at one end of the inserts abuts the adjacent end of the knuckle portion, and the tubular body portion is engaged within the knuckle portion to inhibit relative rotation. A second hinge leaf includes an attachment portion and a pair of spaced apart knuckle portions along one edge between which the knuckle portion of the first leaf is disposed, and the flange portions of the inserts abut the inner end of its knuckle portions. The knuckle portions of the second hinge leaf have an axially extending passage therein which is coaxial with the passage of the first leaf knuckle portion. Extending through the passages of the knuckle portions of the first and second leaves and in the inserts, is a hinge pin which is engaged with the knuckle portions of the second leaf to prevent relative movement there between. However, it is freely rotatable in the bearing inserts to provide a pivotal connection between the first and second hinge leaves. However, this type of hinge is also difficult to assemble due to the multiplicity of components.

Therefore, there is a need for an improved hinge system that allows for easy assembly of the components of the hinge system.

BRIEF DESCRIPTION OF THE DRAWINGS

The features of the present invention which are believed to be novel are set forth with particularity in the appended claims. The invention may best be understood by reference to the following description taken in conjunction with the accompanying drawings, in the several figures of which like reference numerals identify like elements, and in which:

DETAILED DESCRIPTION

Figure 1:
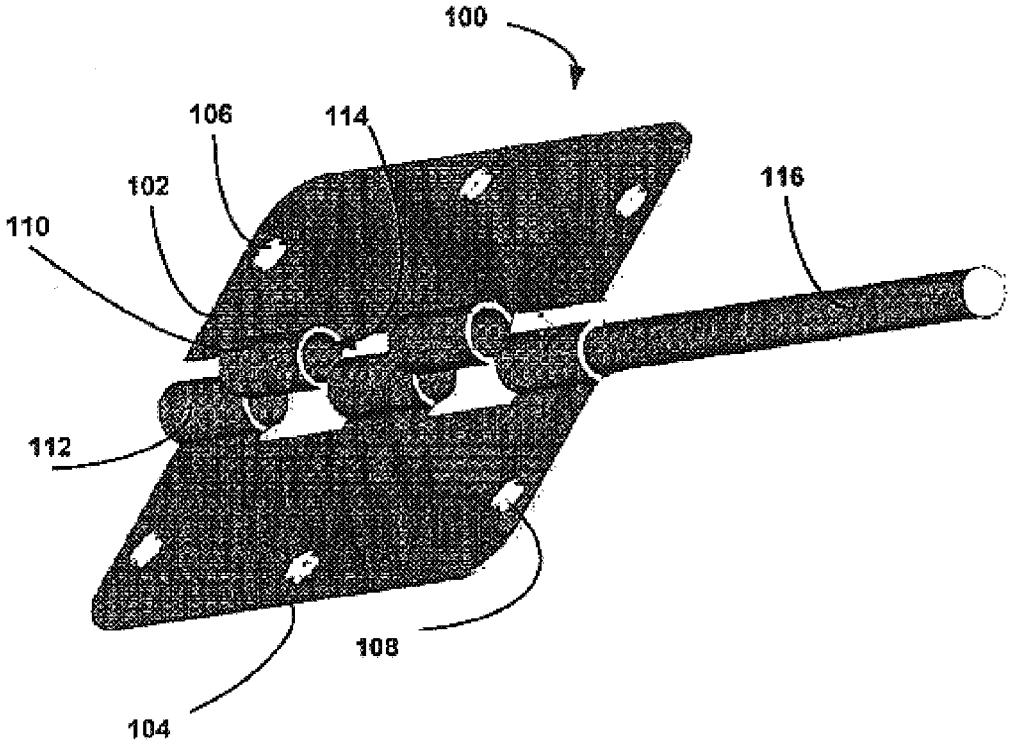
FIG. 1 PRIOR ART
FIG. 1 is a perspective exploded view of a prior art hinge.

While the present invention is susceptible of embodiments of various forms, they are shown in the drawings, and will hereinafter be described, some exemplary and non-limiting embodiments, with the understanding that the present disclosure is to be considered an exemplification of the invention. It is not intended to limit the invention to the specific embodiments illustrated.

FIG. 1 depicts a prior art hinge 100 having first and second leaves 102, 104. Each of the first and second leaves 102, 104 has attachment portions with holes 106, 108 respectively for receiving, for example, screws (not shown). One example of the use of such a hinge is for one leaf to be attached to a door frame and the other leaf to be attached to the edge of a door as is well known. Each of the leaves 102, 104 has knuckle portions 110, 112, respectively. The knuckle portion, such as knuckle portion 110, has a bore 114 that extends through the knuckle portion 110. When the leaves 102, 104 are assembled, the bores of the knuckle portions align and form a passage through which is inserted a hinge pin 116. It is well known that because of the weight of a door, for example, to which one of the leaves is attached, it is difficult to insert the hinge pin 116 through the bores of the knuckle portions of the first and second leaves 102,104. Many times a user must resort to hammering the hinge pin 116 through the bores of the knuckle portions 110,112 thereby damaging the hinge pin 116 as well as the knuckle portions 110,112. Embodiments of the hinge system of the disclosed herein overcome these drawbacks of the prior art hinges.

In general terms the hinge system has a hinge pin having a plurality of cylinders. Each of the cylinders has at least one section having a predetermined diameter, a first cylinder of the plurality of cylinders having a first diameter with every succeeding cylinder having one of a diameter equal to or less than a diameter of a preceding cylinder. The cylinders are arranged end-to-end on a common axis. A first leaf of the hinge systems includes an attachment portion and at least one elongated knuckle portion located on one edge of the attachment portion. The knuckle portion of the first leaf is axially continuous and has an axial extending bore having at least one section having a predetermined diameter. A second leaf of the hinge system includes an attachment portion and at least one knuckle portion along one edge of the attachment portion. The knuckle portion of the second leaf has an axially extending bore, having at least one section having a predetermined diameter, coaxial with the bore of the knuckle portion of the first leaf. The bores of the knuckle portions of the first and second leaves define an axially extending passage having different diameters that correspond to the diameters of the cylinders of the hinge pin. The hinge pin extends through the passage defined by the knuckle portions of the first and second leaves to provide a pivotal connection between the first and second leaves.

Figure 2:
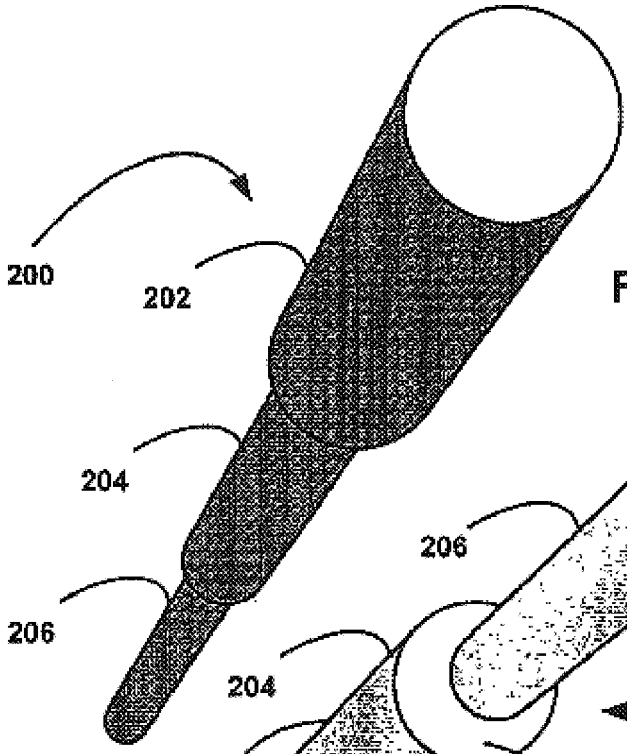
FIG. 2 is a perspective view of one embodiment of a hinge pin for use in the hinge system.
Figure 3:
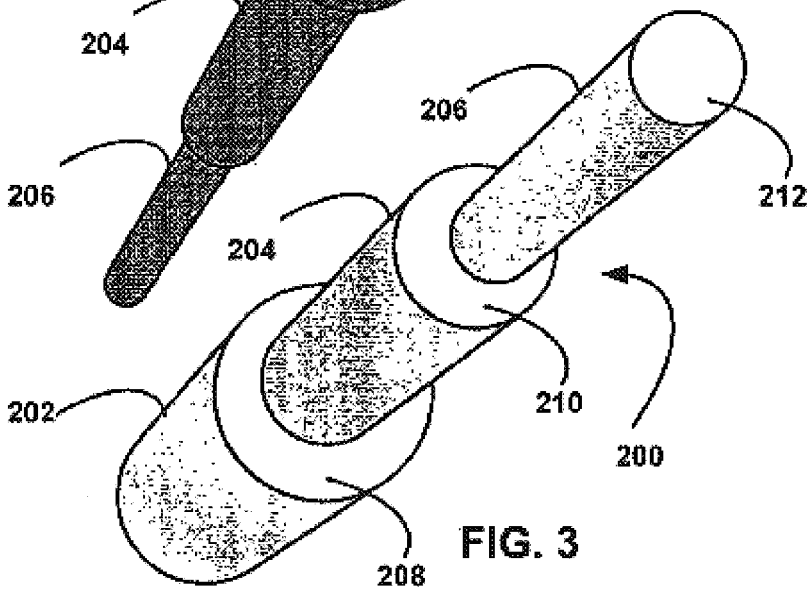
FIG. 3 is another perspective view of an embodiment of a hinge pin for use in the hinge system.

FIGS. 2 and 3 depict one embodiment of a hinge pin for use in the hinge system. The hinge pin 200 may have a plurality of cylinders, such as first cylinder 202, second cylinder 204 and third cylinder 206 as depicted in FIGS. 2 and 3. The cylinders are arranged end to end about a common axis and each of the first, second and third cylinders, 202, 204 and 206 may have a different diameter, or other embodiments may have more than one diameter. The first cylinder 202 has a first diameter with every succeeding cylinder having one of a diameter equal to or less than a diameter of a preceding cylinder. As depicted in each FIG. 2 and 3 the first cylinder 202 has the largest diameter, while the second cylinder 204 has a diameter that is smaller than the diameter of the first cylinder 202 and larger than the diameter of the third cylinder 206. Also as depicted in FIG. 3, the first cylinder 202 has an end-wall 208, the second cylinder 204 has an end-wall 210 and the third cylinder 206 has an end-wall 212. The edges of the end walls may be squared off as depicted in FIG. 3, or may have other curved or angled configurations. Also the hinge pin 200, as depicted in FIGS. 2 and 3, may be formed of various materials, such as steel, brass, plastic, wood, etc. The cylinders of the hinge pin 200 may also be formed from one material, or may be formed separately and joined together.

FIGS. 4–15 depict various embodiments of the leaves and hinge pins of the hinge system.

Figure 4:
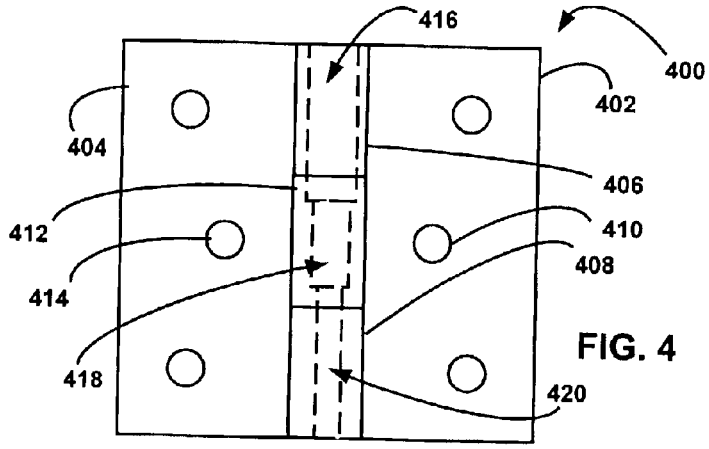
FIGS. 4–15 depict various embodiments of hinge leaves and hinge pins for use in the hinge system.
Figure 5:
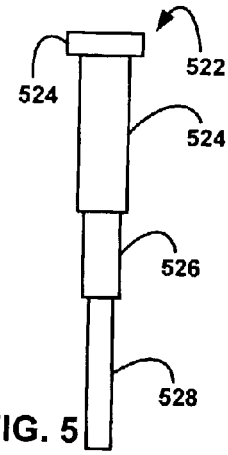

As depicted in FIG. 4 the first and second leaves 402, 404 may have holes 410,414 for accepting screws for mounting the leaves 402, 404 to, for example, a doorframe and door, respectively. Other attachment means could be utilized such as rivets, or the holes 410,414 may be eliminated and the first and second leaves 402,404 may be attached to the respective structures via gluing, welding, etc. The leaves 402,404 may be formed from a variety of materials, such as steel, brass, plastic, wood, etc. The first leaf 402 may have a first knuckle portion 406 having a bore 416 and a second knuckle portion 408 having a bore 420. The second leaf 404 may have a knuckle portion 412 having a bore 418. A hinge pin 522 for use with the FIG. 4 embodiment is depicted in FIG. 5. As depicted, the hinge pin 522 may have a first cylinder 524, a second cylinder 526 and a third cylinder 528. Diameters of the three cylinders 524, 526 and 528 decrease, as depicted in FIG. 5. The hinge pin 522 may also have a cap 524 attached to an end of the first cylinder 524 opposed from an end of the cylinder 524, which is attached to the second cylinder 526.

The bores 416, 418 and 420 and the knuckle portions 406, 412 and 408, respectively, are structured such that they fit the configuration of the cylinders 524, 526 and 528 of the hinge pin 522. That is, the bores 416, 418 and 420 create a passageway for the hinge pin 522. It can be appreciated that when installing the hinge pin 522, the third cylinder 528 first enters the bore 416 and because it is of significantly less diameter than the bore 416 it is easily insertable therein. Only when the hinge pin 522 has been substantially inserted into the passageway, formed by the bores 416, 418, 420, does the hinge pin 522 become snugly fit within the formed passageway. Thus, this provides an easier method of installing the hinge pin 522 for pivotably attaching together the first and second leaves 402, 404.

In the FIG. 4 embodiment, the first knuckle portion 406 has a bore 416 that fits in terms of diameter the first cylinder 524 of the hinge pin 522. The second knuckle portion 408 has a bore 420, which fits in terms of diameter the third cylinder 528 of the hinge pin 522. The knuckle portion 412 of the second leaf 404 has three sections with different diameters such that it fits the first, second and third diameters of the first, second and third cylinders 524, 526 and 528 of the hinge pin 522.

Figure 6:
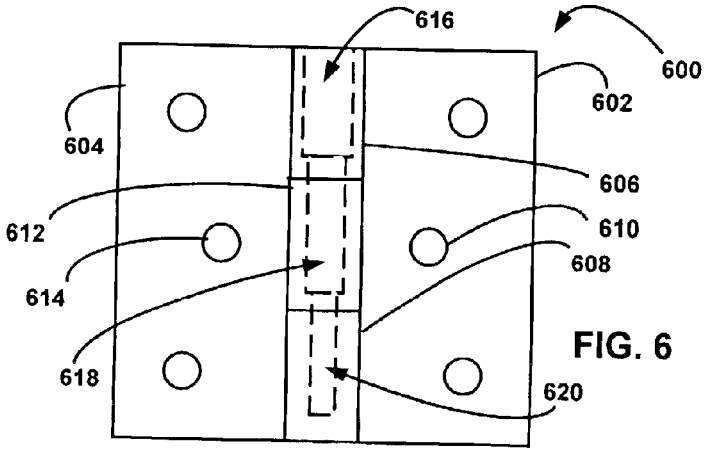

FIG. 6 depicts another embodiment of the first and second leaves 602, 604, which respectively have first and second knuckle portions 606, 608 on knuckle portion 612. Optional mounting holes 610, 614 are provided in the first and second leaves 602, 604, respectively. The bores 616, 618, 620 in the knuckle portions 606, 612, 608, respectively, form a passageway having a configuration as depicted in FIG. 6. It is to be noted that in this embodiment the bore 620 does not extend the full length of the second knuckle 608.

Figure 7:
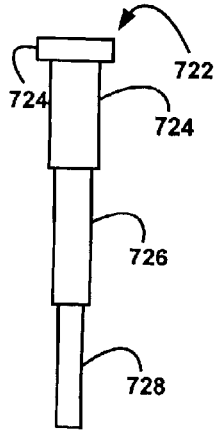

FIG. 7 depict a hinge pin 722 for use with the first and second leaves 602, 604 depicted in FIG. 6. The hinge pin 722 has a first cylinder 724, a second cylinder 726 and a third cylinder 728. A cap 725 may also be provided on the first cylinder 724. The passageway formed by the bores 616, 618 and 620 fit the configuration of the cylinder 724, 726 and 728 of the hinge pin 722. Therefore, when inserted in the passageway the hinge pin 722 pivotably attaches together the leaves 602 and 604.

Figure 8:
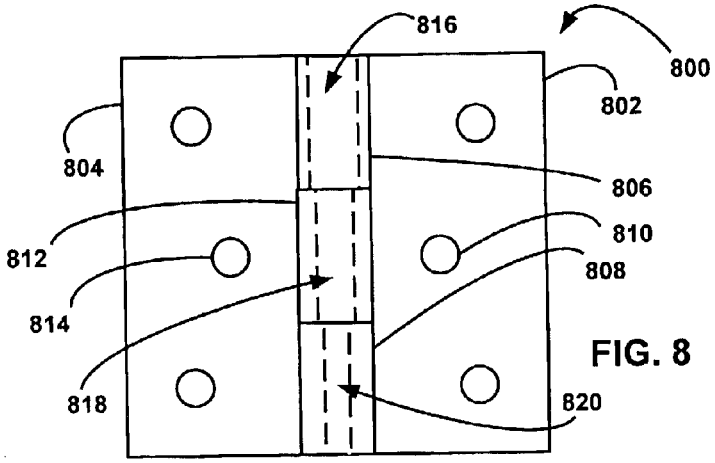
Figure 9:
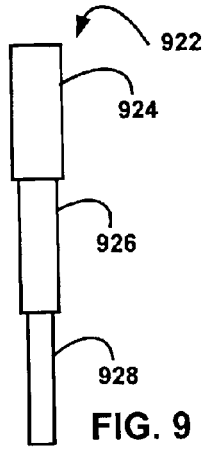

A further embodiment of the hinge system is depicted in FIGS. 8 and 9. In FIG. 8 the first and second leaves 802, 804 have respective knuckle portions 806, 812 and 808, respectively. Optional holes 810, 814 are provided in the first and second leaves 802, 804 for attachment to structural components.

FIG. 9 depicts a hinge pin 922 having a first cylinder 924, a second cylinder 926 and a third cylinder 928. In this embodiment the first knuckle 806 may have a bore 816, which has a diameter that corresponds to the diameter of the cylinder 924 of the hinge pin 922. It is to be understood of course that the diameters would not be exactly equal but would have a slight difference such that the cylinder 924 may slide into the bore 816. The knuckle portion 812 has a bore 818, which has a diameter that accepts the second cylinder 926, and the knuckle portion 808 has a bore 820, which corresponds to the third cylinder 928. In this embodiment it is to be appreciated that each of the knuckle portions 806, 812 and 808 has a single diameter bore, such as bores 816, 818, 820.

Figure 10:
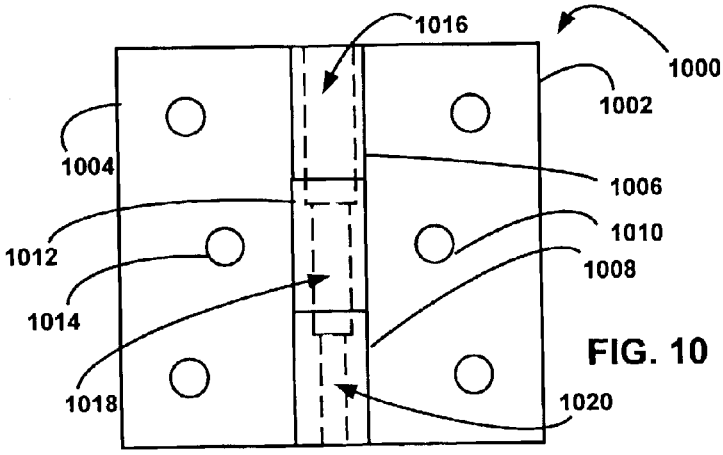
Figure 11:
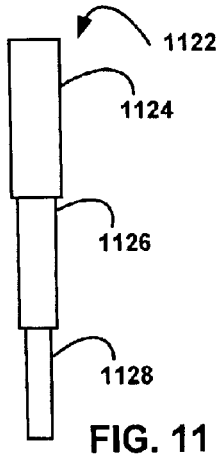

A further embodiment is depicted in FIGS. 10 and 11 wherein leaves 1002 and 1004 have respective knuckle portions 1006, 1012, 1008 with respective bores 1016, 1018, 1020. The first and second leaves 1002, 1004 have optional mounting holes 1010 and 1014, respectively. The hinge pin 1122 depicted in FIG. 11 has a first cylinder 1124, a second cylinder 1126, and a third cylinder 1128. The bores 1016, 1018 and 1020 form a passageway having a configuration as depicted in FIG. 10 and which substantially corresponds to the configuration of the hinge pin 1122.

Figure 12:
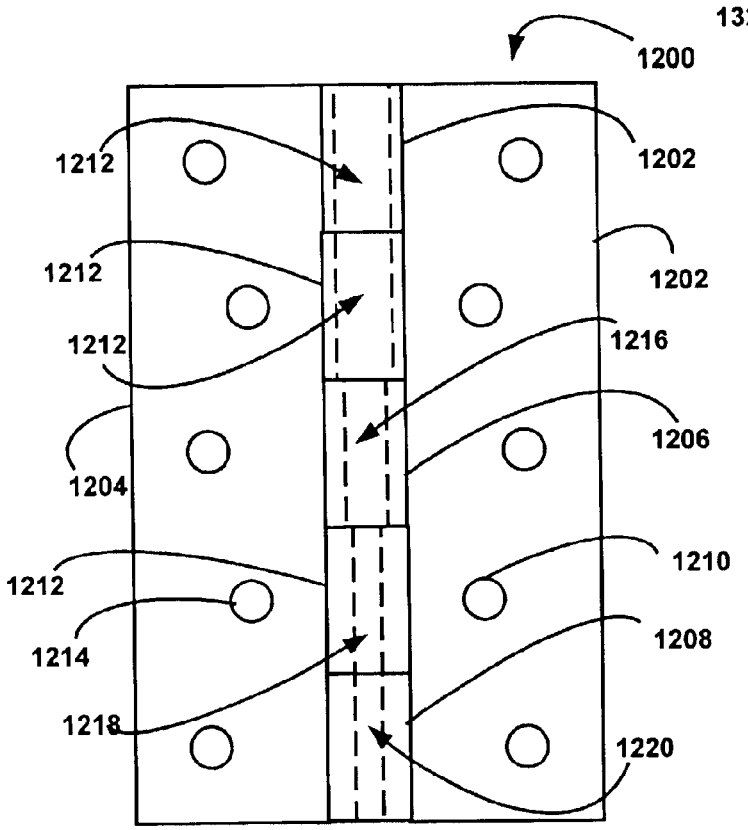
Figure 13:
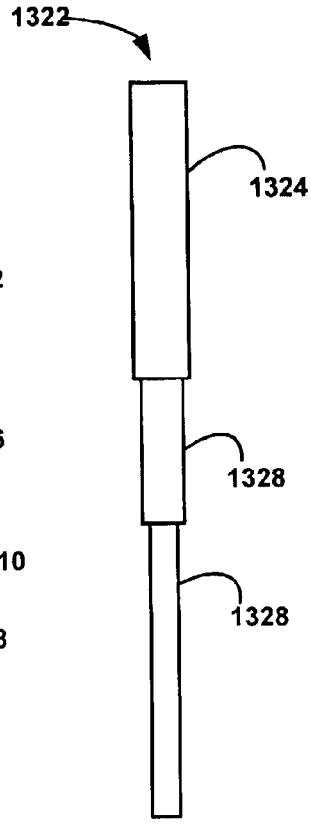

FIGS. 12 and 13 depict a further embodiment of the hinge system wherein the first and second leaves 1202, 1204 have respective knuckle portions 1202, 1212, 1206, 1213, 1208. The leaves 1202 and 1204 may have optional mounting holes 1210 and 1214, respectively. The knuckle portions 1202, 1212, 1206, 1213, 1208 have respective bores 1217, 1215, 1216, 1218 and 1220. These bores form a passageway that corresponds to the hinge pin 1322 depicted in FIG. 13. The hinge pin 1322 has a first cylinder 1324, a second cylinder 1328, and a third cylinder 1330. In this embodiment the leaves 1202 and 1204 each have a plurality of knuckle portions that alternate when the leaves 1202 and 1204 are assembled.

Figure 14:
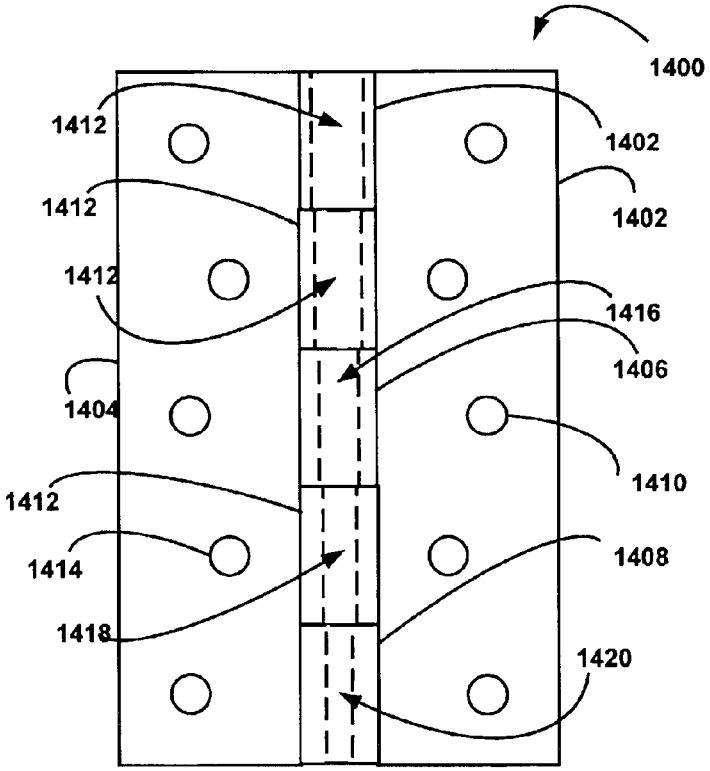
Figure 15:
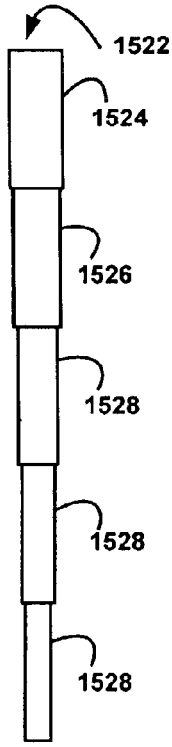

The hinge pin may have any number of cylinders such as depicted in the hinge system of FIGS. 14 and 15. In FIG. 14, the first leaf, 1402 and second leaf 1404 have respective knuckle portions 1402, 1412, 1406, 1413, 1408 that correspondingly have bores 1415, 1417, 1416, 1418 and 1420. These bores form a passageway that corresponds to the cylinders of hinge pin 1522 as depicted in FIG. 15. Hinge pin 1522 has a first cylinder 1524, a second cylinder 1526, a third cylinder 1528, a fourth cylinder 1530 and a fifth cylinder 1532. It is to be appreciated that the hinge pin may have any number of cylinders. Also, the knuckle portions of the leaves of the hinge system may each have a single diameter, which is equal to or different from other diameters of knuckle portions, or may have two or more different diameters such that the knuckle portions form a passageway that accepts a respective hinge pin configuration.

The present invention is not limited to the particular details of the apparatus depicted, and other applications are contemplated. Certain other changes may be made in the above-described apparatus without departing from the true spirit and scope of the invention herein involved. In general, the various embodiments of the system may have components, which are formed from different types of material. Also, the hinge pins may be provided with a cap or may be provided without a cap. Also the leaves of the hinge system may have different styles, such as what is commonly termed as plain or standard, unequal, multiple, multiple barrel, reverse, one leaf reverse, offset, etc. Also the style of the hinge may take different forms such as strap hinges, T-hinges and butt hinges. It is intended, therefore, that the subject matter in the above depiction shall be interpreted as illustrative and not in a limiting sense.

What is claimed is:

1. A hinge system, comprising:

a hinge pin having at least first, second and third cylinder, the second cylinder being of a smaller diameter than the first cylinder and a larger diameter than the third cylinder, the first, second and third cylinder arranged directly adjacent each adjoining cylinder in order of decreasing size and about a common axis;

a first leaf including an attachment portion and at least one elongated knuckle portion located on one edge of the attachment portion, the knuckle portion of the first leaf being axially continuous and having an axially extending bore having at least one section having a predetermined diameter;

a second leaf including an attachment portion and at least one knuckle portion along one edge of the attachment portion, the knuckle portion of the second leaf having an axially extending bore, having at least one section having a predetermined diameter, coaxial with the bore of the knuckle portion of the first leaf;

the bore of the knuckle portions of the first and second leaves defining an axially extending passage having at least first, second and third substantially cylindrical areas having different diameters that correspond to the at least first, second, and third cylinders of the hinge pin;

the hinge pin extending through the passage defined by the knuckle portions of the first and second leaves to provide a pivotal connection between the first and second leaves wherein a diameter of the first cylinder of the hinge pin is greater than a diameter of the second cylinder of the hinge pin, and a diameter of the second cylinder of the hinge pin is greater than a diameter of the third cylinder of the hinge pin, wherein the knuckle portions of the first leaf alternate with the knuckle portions of the second leaf to define the passage, wherein the first leaf has at least first and second knuckle portions and the second leaf has at least one knuckle portion, the bore of the first knuckle portion of the first leaf having a diameter substantially equal to the diameter of the first cylinder of the hinge pin, the bore of the knuckle portion of the second leaf having at least first, second and third sections, the second section being of a smaller diameter than the first section and a larger diameter than the third section, the first, second and third sections arranged directly adjacent each adjoining section in order of decreasing size and corresponding to the first, second and third cylinders of the hinge pin, respectively, and the bore of the second knuckle portion of the first leaf having a diameter substantially equal to the diameter of the third cylinder of the hinge pin.

2. A hinge system, comprising:

a hinge pin having at least first, second and third cylinders, the second cylinder being of a smaller diameter than the first cylinder and larger diameter than the third cylinder, the first, second and third cylinders arranged directly adjacent each adjoining cylinder in order of decreasing size and about a common axis;

a first leaf including an attachment portion and at least one elongated knuckle portion located on one edge of the attachment portion, the knuckle portion of the first leaf being axially continuous and having an axially extending bore having at least one section having a predetermined diameter;

a second leaf including an attachment portion and at least one knuckle portion along one edge of the attachment portion, the knuckle portion of the second leaf having an axially extending bore, having at least one section having a predetermined diameter, coaxial with the bore of the knuckle portion of the first leaf;

the bores of the knuckle portions of the first and second leaves defining an axially extending passage having at least first, second and third substantially cylindrical areas having different diameters that correspond to the at least first, second, and third cylinders of the hinge pin;

the hinge pin extending through the passage defined by the knuckle portions of the first and second leaves to provide a pivotal connection between the first and second leaves wherein a diameter of the first cylinder of the hinge pin is greater than a diameter of the second cylinder of the hinge pin, and a diameter of the second cylinder of the hinge pin is greater than a diameter of the third cylinder of the hinge pin, wherein the knuckle portions of the first leaf alternate with the knuckle portions of the second leaf to define the passage, wherein the first leaf has at least first and second knuckle portions and the second leaf has at least one knuckle portion, the bore of the first knuckle portion of the first leaf having a diameter that corresponds to the first cylinder of the hinge pin, the bore of the second knuckle portion of the first leaf having first and second sections with first and second diameters, respectively, that correspond respectively to the second and third cylinders of the hinge pin, the bore of the knuckle portion of the second leaf having first and second sections with first and second diameters, respectively, that correspond respectively to the first and second cylinders of the hinge pin, to a diameter substantially equal to the diameter of the first cylinder of the hinge pin.

3. The hinge system according to claim 2, wherein the hinge pin has a cap on a first end of the first cylinder that is opposed from a second end of the first cylinder that is adjacent the second cylinder.

4. The hinge system according to claim 2, wherein the bore of the second knuckle of the first leaf extends a distance into the second knuckle of the first leaf that is less than a length of the second knuckle of the first leaf.

5. A hinge system, comprising:

a hinge pin having at least first, second and third cylinders, the second cylinder being of a smaller diameter than the first cylinder and larger diameter than the third cylinder, the first, second and third cylinders arranged directly adjacent each adjoining cylinder in order of decreasing size and about a common axis;

a first leaf including an attachment portion and at least one elongated knuckle portion located on one edge of the attachment portion, the knuckle portion of the first leaf being axially continuous and having an axially extending bore having at least one section having a predetermined diameter;

a second leaf including an attachment portion and at least one knuckle portion along one edge of the attachment portion, the knuckle portion of the second leaf having an axially extending bore, having at least one section having a predetermined diameter, coaxial with the bore of the knuckle portion of the first leaf;

the bores of the knuckle portions of the first and second leave defining an axially extending passage having at least first, second and third substantially cylindrical areas having different diameters that correspond to the least first, second, and third cylinders of the hinge pin;

the hinge pin extending through the passage defined by the knuckle portions of the first and second leaves to provide a pivotal connection between the first and second leaves wherein a diameter of the first cylinder of the hinge pin is greater than a diameter of the second cylinder of the hinge pin, and a diameter of the second cylinder of the hinge pin is greater than a diameter of the third cylinder of the hinge pin, wherein the knuckle portions of the first leaf alternate with the knuckle portions of the second leaf to define the passage, wherein the first leaf has at least first and second knuckle portions and the second leaf has at least one knuckle portion, the bore of the first knuckle portion of the first leaf having first and second sections with first and second diameters, respectively, that correspond respectively to the first and second cylinders of the hinge pin, the bore of the second knuckle portion of the first leaf having a diameter that corresponds to the third cylinder of the hinge pin, the bore of the knuckle portion of the second leaf having first and second sections with first and second diameters, respectively, that correspond respectively to the second and third cylinders of the hinge pin.

6. The hinge system according to claim 5, wherein the hinge pin has a cap on a first end of the first cylinder that is opposed from a second end of the first cylinder that is adjacent the second cylinder.

7. The hinge system according to claim 5, wherein the bore of the second knuckle of the first leaf extends a distance into the second knuckle of the first leaf that is less than a length of the second knuckle of the first leaf.

* * * * *